US006927349B1

(12) United States Patent
Flegel et al.

(10) Patent No.: US 6,927,349 B1
(45) Date of Patent: Aug. 9, 2005

(54) IN-LINE ELECTRICAL SWITCH INTERLOCK WITH SWITCH RETENTION FEATURE

(75) Inventors: Michael O Flegel, Racine, WI (US); David D. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 81 days.

(21) Appl. No.: 10/288,839

(22) Filed: Nov. 6, 2002

(51) Int. Cl.[7] ..... H01H 9/20

(52) U.S. Cl. ..... 200/50.32; 200/50.33; 200/50.35; 200/50.01

(58) Field of Search ..... 200/50.21, 50.02, 200/50.11, 50.33, 50.35, 294; 361/634, 652, 654, 673

(56) References Cited

U.S. PATENT DOCUMENTS 5,648,646 A * 7/1997 Flegel ..... 200/50.32
5,978,209 A * 11/1999 Montague et al. ..... 361/634
6,031,193 A * 2/2000 Flegel ..... 200/50.33
6,096,986 A * 8/2000 Flegel ..... 200/50.33
6,180,897 B1 * 1/2001 Montague et al. ..... 200/50.35
6,521,849 B1 * 2/2003 Flegel ..... 200/50.32

* cited by examiner

*Primary Examiner*—Michael A. Friedhofer
(74) *Attorney, Agent, or Firm*—Boyle, Fredrickson, Newholm, Stein & Gratz, S.C.

(57) ABSTRACT

An interlock arrangement for a pair of aligned switches, for preventing both switches from being on at the same time, includes a feature that prevents the switches from being inadvertently disengaged from mounting structure associated with an electrical panel to which the switches are mounted. The interlock arrangement includes an interlock base member that extends through aligned openings defined by the switch operating members. A pair of inner engagement members interact with the switch operating members so as to ensure that the switch operating members cannot both be in the ON position. An outer engagement member is secured to the interlock base member outwardly of each switch operating member. The interlock base member overlies and engages edges defined by the switches and the outer engagement members engage the switch operating members, to prevent inadvertent removal of the switches. The interlock arrangement further includes a retainer for preventing inadvertent disengagement of the inner engagement members from the interlock base member.

20 Claims, 3 Drawing Sheets

IN-LINE ELECTRICAL SWITCH INTERLOCK WITH SWITCH RETENTION FEATURE

BACKGROUND AND SUMMARY OF THE INVENTION

This invention relates to an interlock for aligned switches, and more particularly to an interlock that prevents two aligned switches from both being in the ON position at the same time, such as in an application in which an electrical panel is capable of being supplied with power from either a primary or a secondary source of power. Interlock arrangements are commonly employed in an electrical supply system which is capable of having power supplied from two different sources. Illustratively, an electrical panel or other power distribution device may be interconnected with a primary source, e.g. an electric utility, as well as a secondary power source, such as an electrical generator, so as to enable power to be supplied in the event of an interruption in the primary power source. Each power source is interconnected with a switch for controlling the supply of power to the electrical panel or other power distribution device. The interlock arrangement ensures that the switch connecting the secondary power source is not in the ON position when an aligned switch connecting the primary power source is in the ON position, and vice versa. An example of an interlock of this type is shown and described in Flegel U.S. Pat. No. 6,031,193, the disclosure of which is hereby incorporated by reference.

In a typical installation, the pair of aligned switches are engaged in a cabinet or the like, which includes a power supply contact member with which the switches are engaged. The cabinet further includes a mounting arrangement for maintaining the switches in position within the cabinet and in engagement with the contact member. Typically, the switches can be individually engaged with the contact member and removed from the contact member.

It is an object of the present invention to provide a switch interlock arrangement which functions to ensure that two adjacent, aligned switches cannot both be in the ON position at the same time, and which is operable to prevent disengagement of the switches from the power supply contact member. It is a further object of the invention to provide such an interlock arrangement which does not require any alteration or modification of the existing structure of the switches or the mounting arrangement by which the switches are engaged within the cabinet with the contact member. It is another object of the invention to provide such an interlock arrangement which is relatively simple in its components, construction and installation, yet which is highly effective to provide both an interlock function and to maintain the switches in engagement with the contact member. Yet another object of the invention is to provide such an interlock arrangement which can be removed and replaced relatively easily, when it is desired to remove one or both of the switches. It is a further object of the invention to provide such an interlock arrangement which provides similar operation as prior art interlock arrangements which have proven performance and construction.

In accordance with the present invention, a pair of switches, such as may be interconnected with separate sources of electrical power, are engaged with an electrical contact member associated with an electrical panel or the like. The switches are aligned with each other, and include operating members movable between ON and OFF positions. Each switch includes a switch body to which the operating member is mounted for movement between the ON and OFF positions, and the switch body is engaged with a mounting arrangement associated with the electrical panel or the like, and with the electrical contact member. Each switch operating member includes an actuator portion spaced outwardly from a surface defined by the switch body. An interlock arrangement is adapted to interact with the actuator portions of the switch operating members, and is configured to prevent the operating members from being in the ON position at the same time. In addition, the interlock arrangement is configured to prevent disengagement of the switch bodies from the mounting arrangement and movement of the switch bodies out of engagement with the contact member.

The interlock arrangement is preferably in the form of an interlock base member which is placed between the outer actuator portion of each operating member and the outwardly facing surface of the switch body from which the outer actuator portion is spaced, such that the interlock base member is located within an opening defined by each switch operating member.

A pair of inner engagement members are secured to the interlock base member between the switch operating members. The inner engagement members are spaced apart from each other, and are located and arranged so as to engage the outer actuator portions of the operating members as one or the other of the operating members is moved to its ON position, to ensure that the other operating member is in its OFF position.

The interlock arrangement further includes a pair of outer engagement members, each of which is located outwardly of the outer actuator portion of one of the operating members. In this manner, each outer actuator portion is located between one of the inner engagement members and one of the outer engagement members.

The interlock base member overlies adjacent edges defined by the switch bodies when the switch bodies are in engagement with the mounting arrangement and with the electrical contact member. In the event an outward force is applied to one or both of the switch bodies, the interlock member functions to engage the edges of the switch bodies. The outer engagement members are moved into contact with the outer actuator portions of the operating members, so as to provide a binding action which prevents disengagement of the switch bodies from the mounting arrangement and from the electrical contact member.

The inner engagement members are preferably engaged with the interlock base member subsequent to insertion of the interlock base member through the openings defined by the switch operating members. In one form, the inner engagement members have a common mounting section therebetween, which is provided with a pair of openings. Threaded fasteners extend through the openings into engagement with aligned threaded openings formed in the interlock base member, to secure the mounting section to the interlock base member. Similarly, one or both of the outer engagement members may be interconnected with a mounting section which is adapted to be secured to the interlock base member via one or more fasteners.

The present invention further contemplates a retainer arrangement for preventing inadvertent removal of the threaded fasteners that secure the inner engagement members to the interlock base member. The retainer arrangement is preferably in the form of a movable retainer member which is movable between an engaged position and a release position. When the retainer member is in its engaged position, the retainer member overlies and engages the threaded fasteners so as to prevent outward movement of the threaded fasteners, and thereby to prevent the inner engagement members from being inadvertently disengaged from the interlock base member. In its release position, the retainer member is configured to expose the fasteners, so as to enable the inner engagement members to be removed in the event it is required to remove the interlock arrangement so as to service or repair one or the other of the switches.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
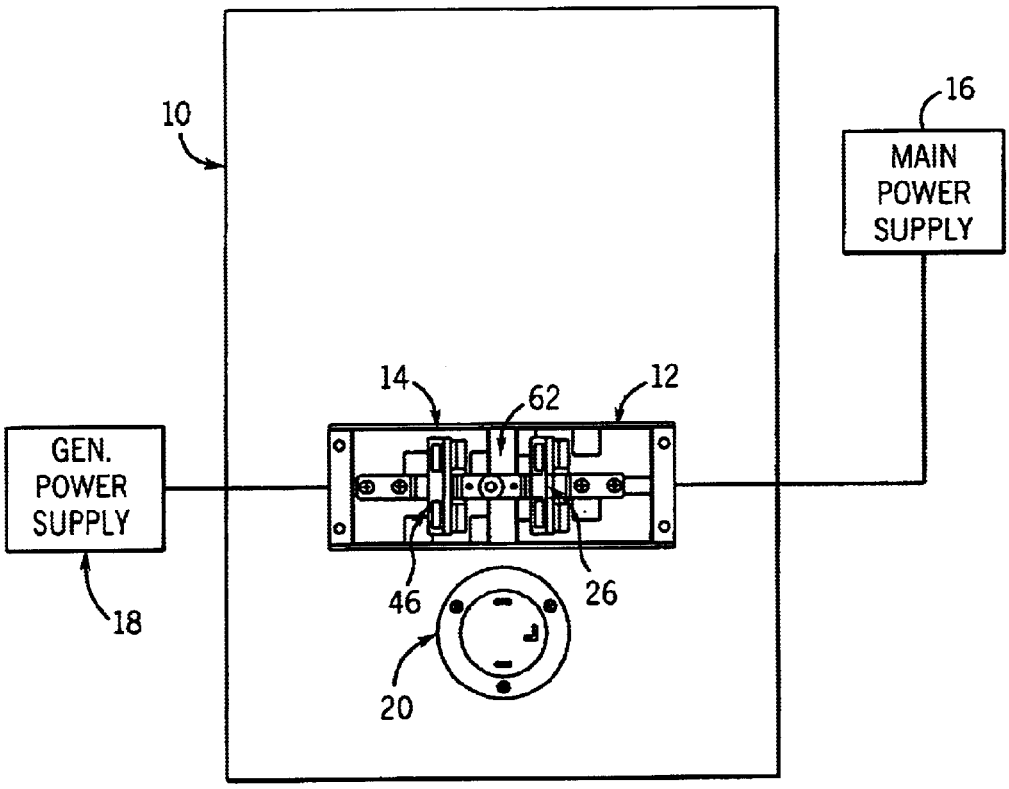
FIG. 1 is a schematic elevation view illustrating an electrical panel or other power distribution arrangement, incorporating a pair of aligned switches and the interlock arrangement of the present invention.

Referring to FIG. 1, a power distribution system, such as an electrical panel, is schematically illustrated at 10. In a manner as is known, electrical panel 10 includes a pair of switches shown at 12, 14 which are interconnected with separate sources of electrical power. In the illustrated embodiment, switch 12 is supplied with power from a main or primary power supply 16, such as utility power, and switch 14 is interconnected with an alternate source of power, such as an electrical generator 18 for supplying power to electrical panel 10 in the event of a utility power outage or other interruption in the primary source of electrical power. Generator power may be supplied to switch 14 through engagement of a generator power cord with a receptacle 20, or in any other satisfactory manner. In addition to switches 12 and 14, electrical panel 10 includes a series of branch switches, which may be in the form of circuit breakers, for controlling the supply of power to individual branch circuits, in a known manner. The general construction and operation of electrical panel is known in the prior art, and electrical panel 10 may representatively be a panel such as is available from Reliance Controls Corporation of Racine, Wis. under its TR series.

Figure 2:
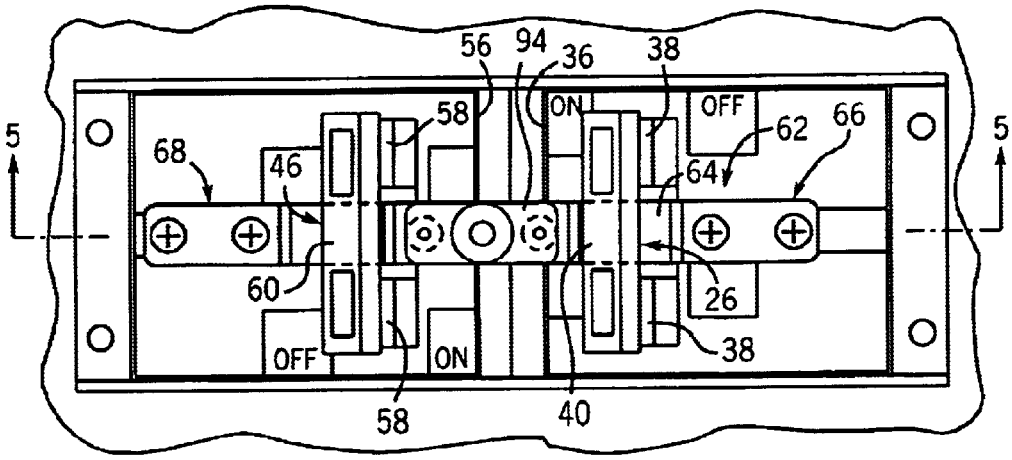
FIG. 2 is an enlarged elevation view showing the pair of aligned switches illustrated in FIG. 1 and the interlock arrangement of the present invention.
Figure 3:
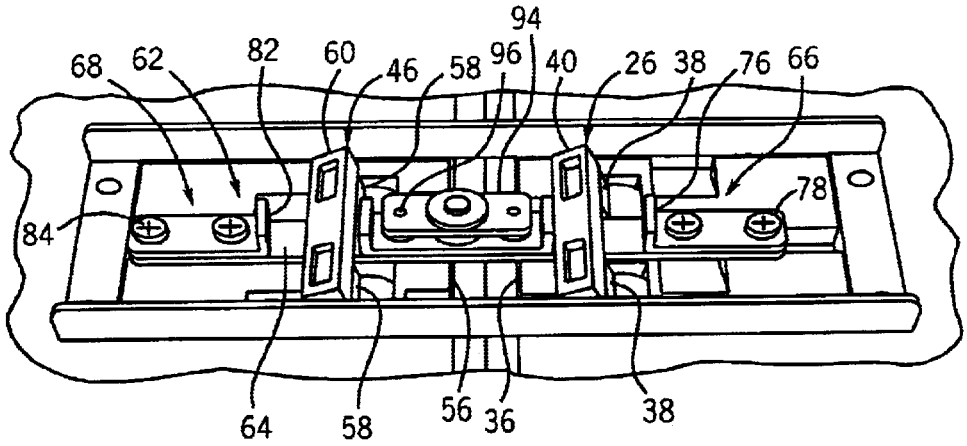
FIG. 3 is a partial isometric view showing the interlock arrangement of the present invention and outer portions of the switches, as shown in FIGS. 1 and 2.
Figure 5:
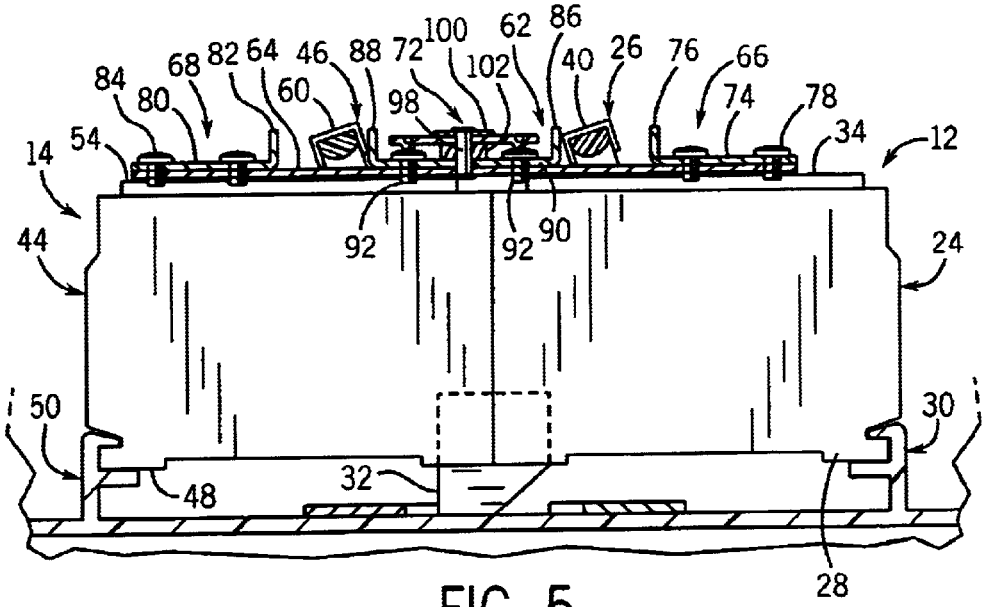
FIG. 5 is a partial section view taken along line 5—5 of FIG. 2.

As shown in FIGS. 2, 3 and 5, switch 12 includes a switch body 24 and an operating member 26 which is movable relative to switch body 24 between ON and OFF positions. Switch body 24 includes a foot 28 which is engageable with a mounting bracket 30 associated with a switch mounting assembly secured to the back wall of electrical panel 10, in a known manner. In addition, switch body 24 includes a slot within which a power supply contact member 32 is received, for supplying power to switch 12. Contact member 32 is one of a number of similarly configured contact members provided within electrical panel 10, each of which is adapted to have a switch, such as a circuit breaker, engaged therewith. Switch body 24 further includes an outwardly facing area 34, from which operating member 26 extends. Outwardly facing area 34 defines an inner edge 36 located inwardly of operating member 26. In accordance with known construction, operating member 26 includes a pair of switch actuator arms 38. A tie member 40 is connected to the outer ends of arms 38, and bridges the space between arms 38. Tie member 40 functions as an outer actuator portion of operating member 26, and is adapted for manual engagement by a user for moving operating member 26 between its ON and OFF positions. Arms 38 are spaced apart from each other, and tie member 40 extends across the space between arms 34 so that arms 38 and tie member 40 function to define an opening in operating member 26.

Switch 14 has a similar construction to that of switch 12, including a switch body 44 and an operating member 46. Switch body 44 includes one or more feet 48 adapted for engagement with a mounting bracket 50 having a mirror image construction to that of mounting bracket 30. Switch body 44 further includes a slot within which contact member 32 is received, for supplying power to switch 14. Switch body 44 further defines an outwardly facing area 54 forming an edge 56 located inwardly of operating member 46, and spaced from edge 36 defined by outwardly facing area 34 of switch body 24. Operating member 46 is defined by a pair of actuator arms 58 which are spaced apart from each other, and a tie member 60 is connected to the outer ends of arms 58, extending across the space therebetween. Tie member 60 thus functions to bridge the space between actuator arms 58, and cooperates with arms 58 to define an opening in operating member 46.

An interlock arrangement, shown generally at 62, interacts with respective switch bodies 24, 44 and operating members 26, 46, for preventing operating members 26, 46 from both being in the ON position at the same time. In this manner, interlock arrangement 62 is operable to ensure that electrical panel 10 is not simultaneously supplied with power from both primary power supply 16 and generator power supply 18.

Interlock arrangement 62 includes an interlock base member 64, a pair of outer engagement members 66, 68 secured to opposite ends of interlock base member 64, and a central interlock section 72 secured to interlock base member 64 between operating members 26 and 46.

Interlock base member 64 is in the form of an elongated flat strip having a series of threaded openings along its length. Interlock base member 64 has a height and width less than that of the opening associated with each operating member 26, 46, such that interlock base member 64 can be inserted between actuator arms 38, 58 and between the underside of tie members 40, 60 and the upwardly facing surfaces of outwardly areas 34, 54. With this arrangement, interlock base member 64 enables interlock arrangement 62 to slide axially relative to switch bodies 24, 44 and operating members 26, 46. Interlock base member 64 is installed in this manner prior to mounting of outer engagement members 66, 68 and central interlock section 72 therewith.

Subsequent to installation of interlock base member 64 in this manner, outer engagement members 66, 68 and central interlock section 72 are assembled to interlock base member 64. Outer engagement member 66 includes a mounting section 74 and an upstanding engagement section 76, which extends perpendicularly from mounting section 74. Mounting section 74 includes a pair of openings in alignment with threaded openings formed in interlock base member 64, and threaded fasteners such as screws 78 extend through the aligned openings into engagement with the threaded openings in interlock base member 64 for securing outer engagement member 66 to interlock base member 64. With this arrangement, engagement section 76 faces the outer surface of tie member 40. In a similar manner, outer engagement member 68 includes a mounting section 80 and an upwardly extending engagement section 82. Mounting section 80 includes a pair of openings through which a pair of screws 84 extend into engagement with aligned threaded openings formed in interlock base member 64. Engagement section 82 extends perpendicularly relative to mounting section 80, and faces the outer surface of tie member 60.

Central interlock section 72 includes spaced apart inner engagement sections 86, 88 and a mounting section 90 extending therebetween. A pair of openings are formed in mounting section 90, and a pair of screws 92 extend through the openings in mounting section 90 into aligned threaded openings in interlock base member 64, to secure central interlock section 72 to interlock base member 64 between switch operating members 26, 46. Inner engagement sections 86, 88 extend substantially perpendicularly to mounting section 90, and face the inner surfaces of tie members 40, 60, respectively.

Figure 4:
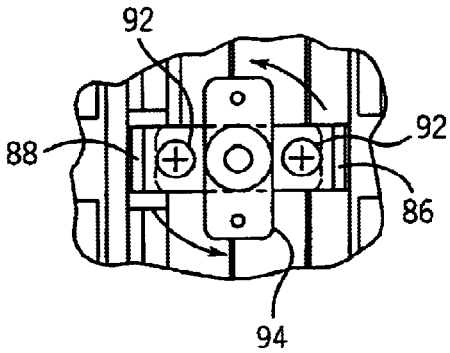
FIG. 4 is a partial top plan view showing a retainer arrangement incorporated in the interlock arrangement of the present invention as shown in FIGS. 1–3.

A retainer 94 is pivotably mounted between screws 92, for preventing inadvertent removal of central interlock section 72. Retainer 94 includes a pair of indentations 96 located one adjacent each end of retainer 94. A mounting pin 98, which may be in the form of a rivet, extends through a washer 100 that overlies the central portion of retainer 94, and through a spacer 102 located between retainer 94 and mounting section 90. Pin 98 extends through aligned openings in mounting section 90 and in interlock base member 64, and functions to define a pivot axis about which retainer 94 is pivotable between a blocking or engaged position and a release position. FIGS. 3 and 5 illustrate retainer 94 in its engaged position, wherein indentations 94 engage the slots in the heads of screws 92 so as to ensure that screws 92 do not inadvertently back out of engagement with the threaded openings in interlock base member 64. Retainer 94 can be manually moved to its release position as shown in FIG. 4 by applying a twisting force to the opposite ends of retainer 94, which disengages indentations 96 from the slots in the heads of screws 92 so as to provide access to screws 92.

Figure 6:
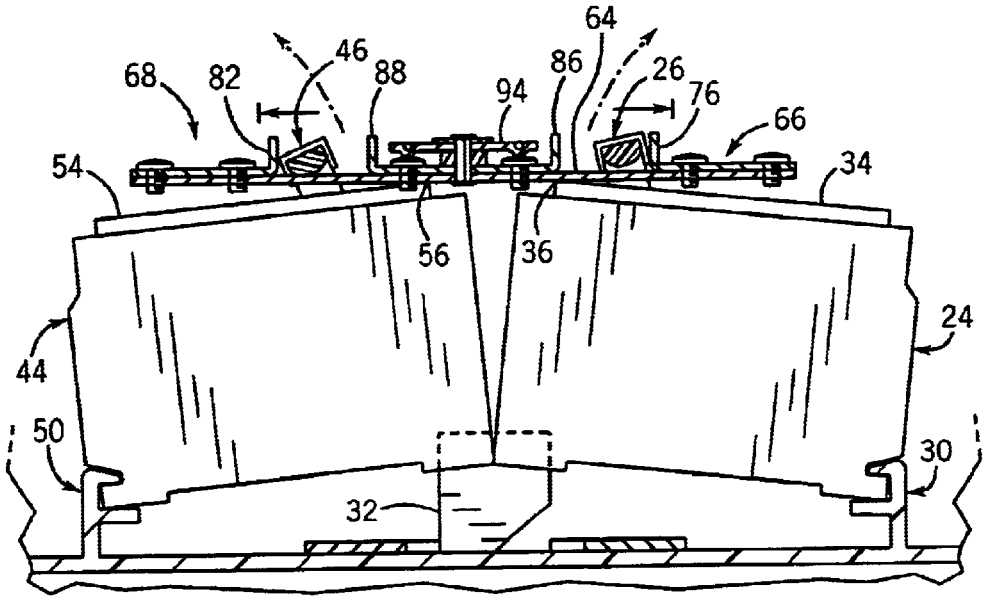
FIG. 6 is a view similar to FIG. 5, showing the manner in which the interlock arrangement of the present invention prevents removal of the switches from the electrical contact member and the mounting arrangement of the panel.

In operation, central interlock section 72 functions to ensure that switch operating members 26 and 46 are not in the ON position at the same time, in the same manner as shown and described in Flegel U.S. Pat. No. 6,031,193. In addition, the provision of outer engagement members 66, 68 ensures that switch bodies 24, 44 cannot be inadvertently removed from engagement with electrical contact member 32. This feature is illustrated in FIG. 6, which shows initial movement of switch bodies 24, 44 away from their fully engaged position with contact member 32. When switch bodies 24, 44 are moved outwardly in this manner, feet 28, 48 remain in engagement with brackets 30, 50, respectively, such that switches bodies 24, 44 are moved outwardly in a pivoting-type fashion. When switch bodies 24, 44 attain the position as shown in FIG. 6, interlock base member 64 engages edges 36, 56 and outer engagement members 76, 82 engage switch operating members 26,46, respectively. Interlock base member 64 further engages the downwardly facing edge of tie member 60, such that interlock base member 64 provides a binding force that prevents further outward movement of switch bodies 24, 44, to maintain switches bodies 24, 44 in engagement with mounting brackets 30, 50, respectively, and in contact with electrical contact member 32. In the event it is desired to remove one or both of switches 12, 14, the user first moves retainer member 94 to its release position and removes screws 92, to disengage central interlock section 72 from interlock base member 64. The user further removes either screws 78 or 84 to remove one or the other of outer engagement members 66, 68, respectively, such that interlock base member 64 can be removed to enable switches 12, 14 to be removed.

Figure 7:
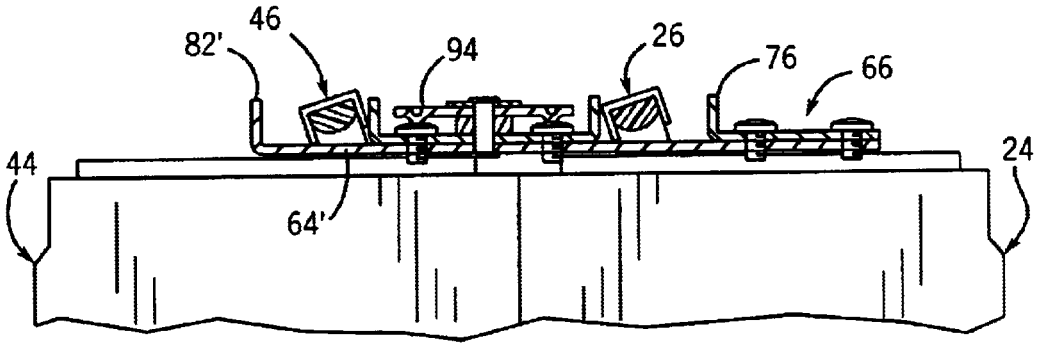
FIG. 7 is a partial elevation view showing an alternative embodiment of the interlock arrangement of the present invention.

While the invention has been shown and described with respect to a specific embodiment, it is understood that various alternatives and modifications are contemplated as being within the scope of the present invention. For example, and without limitation, mounting section 90 need not be common to both inner engagement sections 86 and 88, but rather may take the form of separate mounting sections for each inner engagement member. Further, as shown in FIG. 7, the interlock base member, such as shown at 64', may be modified such that one of the outer engagement members, shown at 82', is in the form of an upturned end of interlock base member 64', to reduce the part count and simplify assembly. Any satisfactory type of pivotable or slidable connection may be provided for retainer member 94, in place of pin 98 and the specific manner in which retainer member 94 is mounted.

Various alternatives and embodiments are contemplated as being within the scope of the following claims particularly pointing out and distinctly claiming the subject matter regarded as the invention.

What is claimed is:

1. An electrical assembly for use in combination with an electrical contact arrangement, comprising:

a pair of aligned switches, wherein each of the switches is engaged with the contact arrangement, and wherein each of the switches has an operating member movable between an ON position and an OFF position; and an interlock arrangement including actuating structure that interacts with the switch operating members for preventing both switches from being in the ON position at the same time, and wherein the interlock arrangement is configured to interact with the operating members and the switches to maintain the switches in engagement with the contact arrangement.

2. The electrical assembly of claim 1, wherein each of the switches includes a switch body and wherein the operating member of each of the switches is located externally of the switch body.

3. The electrical assembly of claim 2, wherein the electrical contact arrangement comprises a contact member and wherein each of the switches includes structure for engaging the contact member, and further comprising a switch mounting arrangement associated with the electrical assembly for securing the switches to the electrical assembly in an engaged position in which the switches are engaged with the contact member, and wherein the interlock arrangement is configured to prevent disengagement of the switches from the contact member and from the switch mounting arrangement.

4. The electrical assembly of claim 3, wherein each of the switch operating members includes an opening and wherein the body of each of the switches includes a surface defining an edge spaced from the operating member of the body, wherein the edges of the switch bodies are located adjacent each other and between the operating members of the switches when the switches are engaged with the contact member and the switch mounting arrangement, wherein the interlock arrangement includes an interlock member that extends through the openings of the switch operating members and overlies the edges of the switch bodies, wherein engagement of the interlock member with the operating members and with the edges of the switch bodies prevents the switches from being disengaged from the switch mounting arrangement and moved out of engagement with the contact member.

5. The electrical assembly of claim 4, wherein the interlock member comprises an elongated base member configured to extend through the openings of the switch operating members, wherein each switch operating member includes an actuator portion adjacent the opening, and wherein the interlock member includes outwardly extending engagement members extending from the base member, wherein a pair of engagement members are located one on either side of the actuator portion.

6. The electrical assembly of claim 5, wherein the outwardly extending engagement members comprise an inner pair of engagement members located between the actuator portions of the switch operating members, and an outer pair of engagement members, wherein each of the outer engagement members is spaced from one of the inner engagement members and wherein the actuator portion of one of the switch operating members is located between one of the inner engagement members and one of the outer engagement members spaced outwardly therefrom.

7. The electrical assembly of claim 6, wherein the switch mounting arrangement and the contact member are configured to provide pivoting movement of the switch bodies into and out of engagement with the contact member, and wherein the base member and the inner and outer engagement members are engaged with the switches subsequent to engagement of the switches with the switch mounting arrangement and the contact member, wherein the base member overlies the edges of the switch bodies and wherein the outer engagement members function to engage the actuator portions of the operating members to prevent disengagement of the switch bodies from the mounting arrangement and the contact member.

8. The electrical assembly of claim 7, wherein the inner engagement members each extend from a mounting section engaged with the elongated base member and secured thereto via a fastener that extends through aligned openings in the base section and the mounting member.

9. The electrical assembly of claim 8, wherein the fasteners comprise threaded fasteners, each of which extends through an opening in one of the mounting sections and into engagement with a threaded opening in the elongated base member, and further comprising a retainer member movable between a blocking position for preventing access to the fasteners and for maintaining the fasteners in engagement with the threaded openings in the base member, and a release position in which the retainer member is disengaged from the fasteners so as to allow access to the fasteners.

10. The electrical assembly of claim 9, wherein the retainer member is pivotably mounted to the elongated base member between the pair of fasteners via a connector, wherein the connector defines a pivot axis about which the retainer member is pivotable between the blocking position and the release position.

11. A method of interconnecting a pair of aligned switches in an electrical panel, wherein the pair of switches are engaged with mounting structure associated with the electrical panel and with an electrical contact member associated with the electrical panel, and wherein each of the switches includes an operating member operable between an ON position and an OFF position, comprising the step of engaging an interlock arrangement with and between the operating members of the pair of switches, wherein the interlock arrangement is operable to prevent both switches from being in the ON position at the same time, and wherein the interlock member is configured to prevent disengagement of the switches from the mounting structure and the electrical contact member.

12. The method of claim 11, wherein the step of engaging the interlock arrangement is carried out subsequent to engagement of the pair of switches with the mounting structure and the electrical contact member.

13. The method of claim 12, wherein each of the switch operating members defines an opening, and wherein the step of engaging the interlock arrangement with and between the switch operating members is carried out by inserting an interlock base member through the openings, and interconnecting inner interlock structure with the base member between the switch operating members, wherein the inner interlock structure is operable to engage the switch operating members to prevent the operating members from being positioned such that both switches are in the ON position at the same time, and interconnecting retainer structure with the base member which is configured to engage at least one of the switch operating members and to engage the switch operating member to prevent removal of the base member.

14. The method of claim 13, wherein the step of interconnecting inner interlock structure with the base member is carried out by securing a pair of upstanding engagement members to the base member, wherein each upstanding engagement member is located and arranged to engage one of the switch operating members to prevent both switch operating members from being moved to place the switches in the ON position at the same time.

15. The method of claim 14, wherein the step of securing the pair of engagement members to the base member is carried out by engaging threaded fasteners with the engagement members and with the base member, and further comprising the step of preventing disengagement of the fasteners by positioning a retainer member in engagement with the fasteners which functions to prevent the fasteners from being rotated.

16. The method of claim 14, wherein the step of inserting the base member through the openings defined by the switch operating members is carried out such that the base member overlies an outwardly facing surface defined by each of the switches, wherein the switches each include an inwardly extending surface that cooperates with the outwardly facing surface to form an edge, and wherein the base member is operable to engage the switch operating members and the switch edges to prevent outward pivoting movement of the switches from engagement with the contact member, wherein the outer retainer members function to engage the switch operating members so as to maintain the interlock arrangement in engagement with the pair of switches.

17. An interlock assembly for a pair of aligned switches, wherein each of the switches includes a switch body that engages an electrical contact member, and a switch operating member for movement between an ON position and an OFF position, wherein each of the switch operating members includes an actuator portion spaced from a switch body defined by one of the switches, comprising:

an interlock base member constructed and arranged to extend between the switch operating members, wherein the interlock base member is located within the space between the switch body and the actuator portion of the operating members;

a pair of engagement members interconnected with the interlock base member via a pair of threaded fasteners, wherein each interlock base member includes an outwardly extending engagement portion, wherein the outwardly extending engagement portions are spaced apart from each other and configured to prevent both switch operating members from being in the ON position at the same time; and a movable retainer for engaging the fasteners so as to prevent inadvertent movement of the fasteners and to maintain the engagement members in engagement with the interlock base member, wherein the retainer is engageable with the fasteners in an engaged position and is movable away from the fasteners in a release position, to enable access to the fasteners so as to provide connection of the engagement members to the interlock base member or removal of the engagement members from the interlocked base member.

18. The interlock assembly of claim 17, wherein the fasteners comprise threaded fasteners with heads, and wherein the retainer member is engaged with the fastener heads in the engaged position so as to prevent outward movement of the fasteners.

19. The interlock assembly of claim 18, wherein the retainer member is pivotably movable between the engaged position and the release position, for movement about a pivot axis located between the pair of fasteners.

20. The interlock assembly of claim 19, wherein the retainer member is pivotably interconnected with a pivot pin located between the pair of fasteners.

* * * * *

UNITED STATES PATENT AND TRADEMARK OFFICE

CERTIFICATE OF CORRECTION

PATENT NO. : 6,927,349 B1
APPLICATION NO. : 10/288839
DATED : August 9, 2005
INVENTOR(S) : Michael O. Flegel It is certified that error appears in the above-identified patent and that said Letters Patent is hereby corrected as shown below:

On the cover page,

[*] Notice: Subject to any disclaimer, the term of this patent is extended or adjusted under 35 USC 154(b) by (81) days Delete the phrase "by 81 days" and insert -- by 154 days --

Signed and Sealed this

Twenty-ninth Day of April, 2008

JON W. DUDAS
*Director of the United States Patent and Trademark Office*